US010385854B2

(12) United States Patent
Stoop

(10) Patent No.: US 10,385,854 B2
(45) Date of Patent: Aug. 20, 2019

(54) SCROLL COMPRESSOR WITH OIL CHAMBER AND COOLING

(71) Applicant: ATLAS COPCO AIRPOWER, NAAMLOZE VENNMOOTSCHAP, Wilrijk (BE)

(72) Inventor: Koen Stoop, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 160 days.

(21) Appl. No.: 15/503,279

(22) PCT Filed: Aug. 4, 2015

(86) PCT No.: PCT/BE2015/000035
§ 371 (c)(1),
(2) Date: Feb. 10, 2017

(87) PCT Pub. No.: WO2016/023086
PCT Pub. Date: Feb. 18, 2016

(65) Prior Publication Data

US 2018/0209424 A1 Jul. 26, 2018

(30) Foreign Application Priority Data

Aug. 14, 2014 (BE) ..... 2014/0619

(51) Int. Cl.
*F01C 1/02* (2006.01)
*F03C 2/00* (2006.01)
(Continued)

(52) U.S. Cl.
CPC ..... *F04C 29/028* (2013.01); *F04C 18/0215* (2013.01); *F04C 29/0057* (2013.01);
(Continued)

(58) Field of Classification Search
CPC .... F04C 18/0215; F04C 29/04; F04C 29/028; F04C 29/0078; F04C 29/0057
(Continued)

(56) References Cited

U.S. PATENT DOCUMENTS 5,066,206 A * 11/1991 Kakuda ..... F01C 1/023 418/55.3
5,842,842 A 12/1998 Callens et al.
(Continued)

FOREIGN PATENT DOCUMENTS

BE 1009475 A3 4/1997
BE 1012016 A3 4/2000
(Continued)

OTHER PUBLICATIONS

International Search Report (ISR) dated Mar. 1, 2016, for PCT/BE2015/000035.
(Continued)

*Primary Examiner* — Theresa Trieu
(74) *Attorney, Agent, or Firm* — Bacon & Thomas, PLLC

(57) ABSTRACT

A helical compressor consisting of a casing with at least one fixed spiral; a rotor that has been placed in the casing and has at least one spiral that can be rotated within the casing; a crankshaft that has a main spindle that is mounted on bearings within the casing and an auxiliary spindle that is eccentrically positioned with respect to the geometric axis of the main spindle. The rotor is attached to the auxiliary spindle using a bearing and there is a mechanism present to prevent the rotor from rotating by itself. The rotor has an oil chamber that is connected to the bearing of the auxiliary spindle and a de-gassing channel for the oil chamber that goes through the auxiliary spindle and through part of the main spindle.

18 Claims, 3 Drawing Sheets

(51) Int. Cl.

| | |
|---|---|
| ***F03C 4/00*** | (2006.01) |
| ***F04C 18/00*** | (2006.01) |
| ***F04C 2/00*** | (2006.01) |
| ***F04C 29/02*** | (2006.01) |
| ***F04C 18/02*** | (2006.01) |
| ***F04C 29/00*** | (2006.01) |
| ***F04C 29/04*** | (2006.01) |
| *F04C 23/00* | (2006.01) |

(52) U.S. Cl.
CPC ..... *F04C 29/04* (2013.01); *F04C 23/008* (2013.01); *F04C 29/0078* (2013.01)

(58) Field of Classification Search
USPC ..... 418/55.1–55.6, 57, 60, 88, 91, 94, 418/97–102
See application file for complete search history.

(56) References Cited

U.S. PATENT DOCUMENTS

2003/0053922 A1* 3/2003 Satoh ..... F04C 18/0215 418/101
2009/0285708 A1 11/2009 Yokoi et al.
2015/0337834 A1* 11/2015 Iwano ..... F04C 18/0215 418/55.2

FOREIGN PATENT DOCUMENTS

EP 0752533 A1 1/1997
JP 9-25884 1/1997
JP 2003-065271 A * 3/2003 ..... F04C 18/0215

OTHER PUBLICATIONS

Japanese Office Action in related Japanese Application No. 2017-508555, dated Jul. 2, 2018.

* cited by examiner

SCROLL COMPRESSOR WITH OIL CHAMBER AND COOLING

The invention relates to a scroll compressor.

BACKGROUND OF THE INVENTION

As is known a scroll compressor comprises a housing with a fixed stator with a fixed scroll; and a movable rotor in this housing with a movable scroll that engages with the fixed scroll; and a crankshaft that has a main shaft that is mounted on bearings in the housing and has an eccentrically located secondary shaft with respect to the geometric axis of the main shaft that is mounted on bearings through the intervention of a 'central bearing' in the rotor; whereby there are means to prevent the rotation of the rotor around its centre such that the rotation of the crankshaft imposes an orbiting motion on the rotor, whereby in other words the rotor can only make a circular motion around the geometric axis of the crankshaft.

The operating principle of such type of scroll compressor is known and is based on the fact that chambers are enclosed by the motion of the rotor between the fixed scroll of the stator and the movable scroll that move from the outer periphery of the scrolls to the centre of the scrolls, whereby during this movement these chambers become increasingly smaller, such that the gas present in the chambers, such as air or another gas or mixture of gases, is compressed.

On the outer periphery of the scrolls an inlet is provided to admit fresh gas, while at the location of the centre of the scrolls an outlet is provided for the supply of compressed gas.

It is known that the compression of a gas is coupled with the generation of heat.

In the case of a scroll compressor the heat developed is partly removed via the compressed gas that leaves the scroll compressor at a relatively high temperature and partly via the rotor and stator, which are provided with cooling fins to this end and which are cooled by the freshly drawn-in gas to be compressed on the one hand, and by active air cooling whereby cold air is blown over the cooling fins of the rotor, on the other hand.

Typically the temperature of the rotor increases from the outer periphery to the centre where the aforementioned central bearing is located.

Good lubrication of this central bearing is vitally important for the lifetime and for the performance of the scroll compressor.

It is known to lubricate this central bearing with grease.

A disadvantage of grease lubrication is that only a limited speed of the rotor is allowed and consequently a limited capacity of the gas flow to be compressed.

Another disadvantage is that with grease lubrication the scroll compressor must be serviced at relatively short intervals, whereby the scroll compressor is stopped for a certain period each time.

It is also known to lubricate the central bearing using oil, which provides advantages with respect to grease lubrication in that higher rotor speeds are allowed with oil lubrication and thus a higher flow rate can be obtained and that the central bearing needs to be serviced less frequently with possibly a shorter stoppage per service.

Such a scroll compressor with oil lubrication of the central bearing is known in BE 1.009.475 and BE 1.012.016, whereby the rotor is provided with an oil chamber that is partially filled with oil and which extends from underneath the rotor to above the level of the central bearing that is connected to this oil chamber via an opening and whereby the oil is splashed upwards to against the central bearing due to the motion of the rotor.

Beyond the advantages of oil lubrication, such a known scroll compressor has another advantage in that a separate cooling circuit with a separate oil pump and pipes is not required.

However, practice shows that with such a known scroll compressor the lubrication is not always sufficient because the splashed-up oil does not circulate effectively, which can lead to damage on account of insufficient lubrication because at the location of the central bearing in the hot part of the rotor itself the oil is not sufficiently replenished and can thereby cool down insufficiently, which can lead to premature deterioration of the lubricating qualities of the oil.

SUMMARY OF THE INVENTION

The purpose of the invention is a scroll compressor that does not present one or more of these and other disadvantages.

To this end the invention concerns a scroll compressor comprising a housing with a fixed stator with a fixed scroll; a movable rotor in this housing with a movable scroll engaging with the fixed scroll; and a crankshaft that has a main shaft that is mounted on bearings in the housing and has a secondary shaft located eccentrically with respect to the geometric axis of the main shaft that is mounted on bearings in the rotor through the intervention of a 'central bearing'; means for preventing the rotation of the rotor around its centre in such a way that the rotation of the crankshaft imposes an orbiting motion on the rotor, whereby the rotor is provided with an oil chamber that is intended to be partly filled with oil such that upon the movement of the rotor a part of the oil is raised in order to lubricate the central bearing and whereby the oil chamber is at a radial distance from the centre of the rotor and is connected to the central bearing by a narrower oil channel.

A narrower oil channel means an oil channel whose width is less than the width of the oil chamber in the tangential direction.

In addition to the already known aforementioned advantages of a scroll compressor with an oil chamber, a scroll compressor with an oil chamber according to the invention has an additional advantage that the oil in the oil chamber heats up less because the oil chamber is situated further from the hot centre of the rotor and is more concentrated along the cooler outer periphery of the rotor, which is favourable for better lubrication of the central bearing.

Preferably cooling air is blown along the outside of the oil chamber by means of a fan or similar, which favours the temperature of the oil as well as the lubrication of the central bearing.

The oil chamber can be provided with cooling fins for better cooling of the oil.

According to a preferred embodiment the oil channel connects to a connecting wall of the oil chamber whereby, at the location of the connection on one side of the oil channel, an oil catcher is provided that can catch at least part of the oil raised by the rotor and channel it in the direction of the oil channel.

The oil catcher ensures a sufficient oil flow to the central bearing.

The oil catcher is formed by a shoulder for example that is formed by the oil channel being connected to the oil chamber at a distance that is larger on one side of the connection than on the other side.

In this way an oil chamber with a suitable form can be realised in a relatively simple way.

BRIEF DESCRIPTION OF THE DRAWINGS

With the intention of better showing the characteristics of the invention, a preferred embodiment of a scroll compressor is described hereinafter by way of an example, without any limiting nature, with reference to the accompanying drawings, wherein.

DETAILED DESCRIPTION OF THE INVENTION

Figure 1:
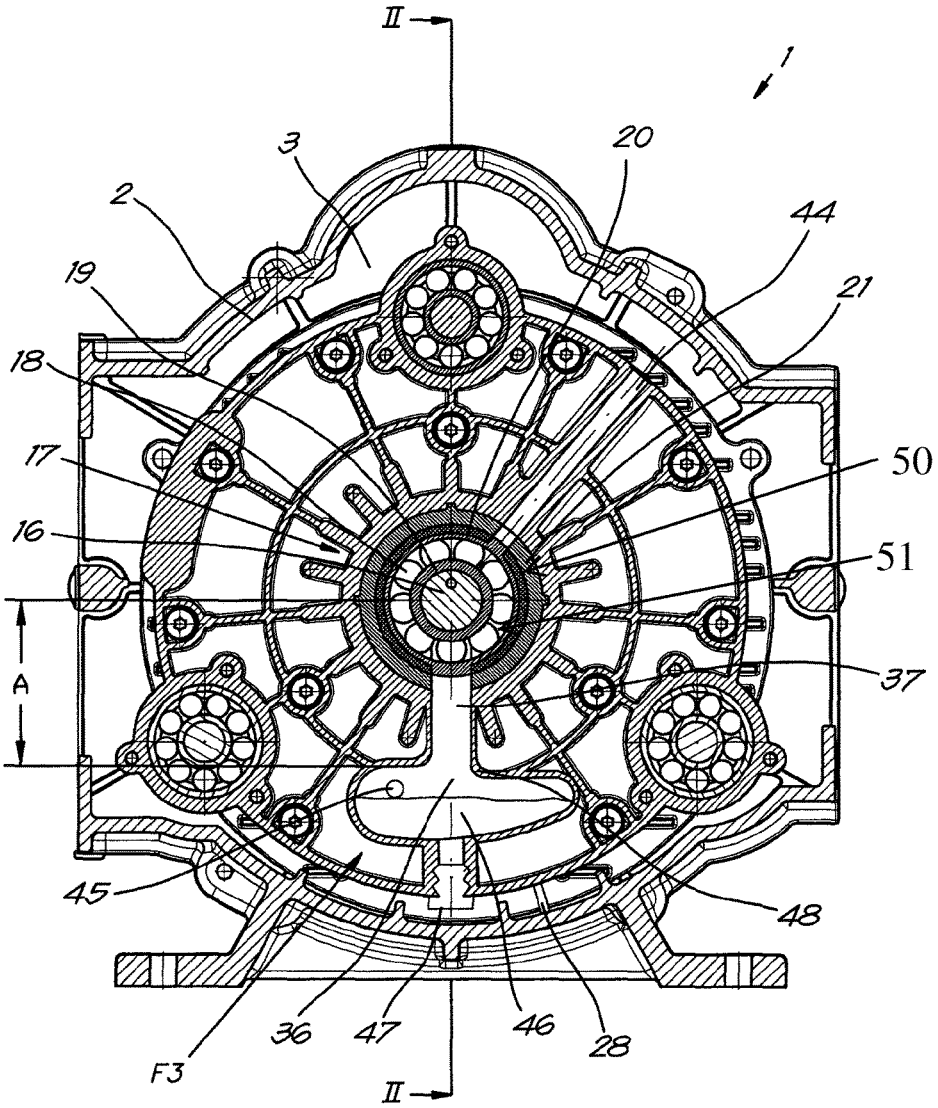
FIG. 1 shows a cross-section of a compressor according to the invention in the rest state.
Figure 2:
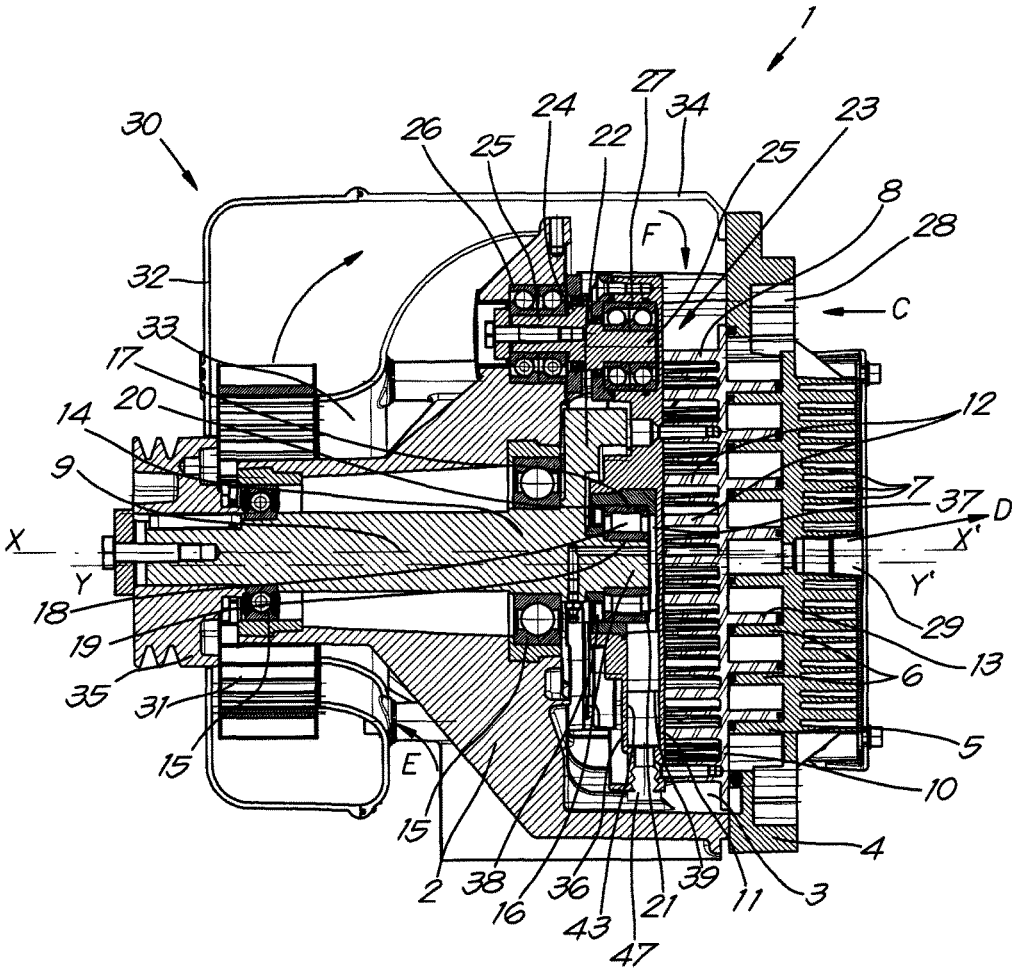
FIG. 2 shows a cross-section according to line II-II in FIG. 1.

The scroll compressor 1 shown in FIGS. 1 and 2 essentially comprises a housing 2 that defines an enclosed space 3 that is covered by a cover 4 of the housing 2, whereby this cover 4 is provided on the inside with a fixed scroll 5 with windings 6 that extend transversely on the inside of the cover 4 and whereby this cover 4 is provided with cooling fins 7 on the outside.

The cover 4 of the fixed scroll 5 forms part of the stator of the scroll compressor 1.

A rotor 8 is provided in the enclosed space 3 that is driven by means of a horizontal crankshaft 9, whereby the rotor 8 is formed by two parallel base plates 10 and 11 that are connected together by means of cooling fins 12 and whereby a movable scroll 13 engaging with the fixed scroll 5 is affixed on the base plate 10.

The crankshaft 9 has a main shaft 14 that can be turned around its axis X-X' and which is mounted on bearings in the housing 2 by means of bearings 15, in this case grease-lubricated ball bearings.

At an end of its main shaft 14, the crankshaft 9 is provided with a secondary shaft 16 with a geometric axis Y-Y' that is parallel to the axis X-X' but is positioned eccentrically with respect to it.

The rotor 8 is provided along the side of the base plate 11 with a central bearing 17, which in this case, but not necessarily, is centred with respect to the centre of the rotor 8, more specifically centred with respect to the centre of the movable scroll of the rotor, and whereby the rotor 8 is mounted on bearings on the secondary shaft 16 so that the centre of the rotor 8 coincides with the geometric axis Y-Y'.

In the example shown, this central bearing 17 is a bearing with cylindrical roller elements 18 that are held between an inner ring 19 and an outer ring 20, whereby the outer ring 20 is provided with upright flanges 21 oriented inwards, between which the roller elements 17 are held in the axial direction Y-Y'.

The crankshaft 9 is further provided with a counterweight 22 to balance this crankshaft 9.

The scroll compressor 1 comprises means 23 to prevent the rotation of the rotor 8 around the Y-Y' axis through its centre in such a way that the rotation of the crankshaft 9 imposes an orbiting motion on the rotor 8 in a known way.

In the example these means 23 are formed by three crankshafts 24 that are each formed by two parallel shaft gudgeons 25 that are coupled together eccentrically and of which one shaft gudgeon 25 is mounted on bearings in the housing 2 by means of a bearing 26, while the other shaft gudgeon 25 is mounted on bearings in the rotor 8 by means of another bearing 27, whereby in this case the bearings 26 and 27 are grease-lubricated ball bearings 26 and 27.

In the housing 2, an inlet 28 is provided along the outer periphery of the fixed scroll 5 and an outlet 29 is provided at the location of the centre of the fixed scroll 5.

In the example the scroll compressor is equipped with a radial fan 30 with a rotor 31 that is fastened on the crankshaft 9 and which is turnably affixed in a spiral casing 32 that is fastened on the housing 2 and which is provided with an inlet 33 and an outlet 34 that leads to the enclosed space 3 for cooling the rotor 8.

The crankshaft 9 can be driven in many ways, for example by means of a pulley 35, as illustrated in FIG. 2.

According to the invention an oil chamber 36 is provided against the base plate 11 that is at a radial distance A from the centre from the rotor 8 underneath the rotor 8 and which is connected to the central bearing 17 via a narrower oil channel 37 for oil lubrication of this central bearing 17, in other words via an oil channel 37 whose width W is smaller than the width W' of the oil chamber 36 viewed in an essentially tangential direction to the spiral scroll 13 of the rotor 8.

The oil chamber is preferably located as far as possible from the hot zone in the centre of the rotor 8, for example at a distance A that is greater than ⅓, preferably greater than one half, of the radius of the outer periphery of the rotor 8.

If need be, the oil chamber 36 and the oil channel 37 are integrated in the base plate 11 by being cast as one unit. However, it is not excluded that the oil chamber 36 and the oil channel 37 are assembled from separate parts that are mounted on the rotor 8.

In the embodiment shown, the oil channel 37 is constructed as a straight radially extending oil channel that runs vertically upwards from the oil chamber 36 along an open side of the central bearing 17.

The other open side of the central bearing 17 is sealed by means of a seal.

The oil chamber 36 is defined by two opposite walls 39 and 40, respectively a connecting wall 39 on top to which the oil channel 37 connects and which is oriented transversely to the oil channel 37 and a base 40 that extends essentially along a circular segment with a centre on the Y-Y' axis, whereby these walls 39 and 40 are connected together by means of two curved concave sidewalls 41 and 42 that are seamlessly connected to the aforementioned walls 39 and 40.

A cover wall 43 further closes off the oil chamber 36.

In order to fill the oil chamber 36, the rotor is provided with a filling channel 44 that is connected from the outer periphery of the rotor 8 at the top to the oil chamber 36, either directly or via the central bearing 17 and the oil channel 37, such as in FIGS. 1 and 2.

In the rest state, the oil chamber 36 is fifty to sixty percent filled with oil 46.

A gauge glass 45 can be provided in the cover wall 43 to be able to fill the oil chamber to a suitable level.

A drain plug 47 is affixed in the bottom wall 40 to be able to replenish the oil.

Figure 3:
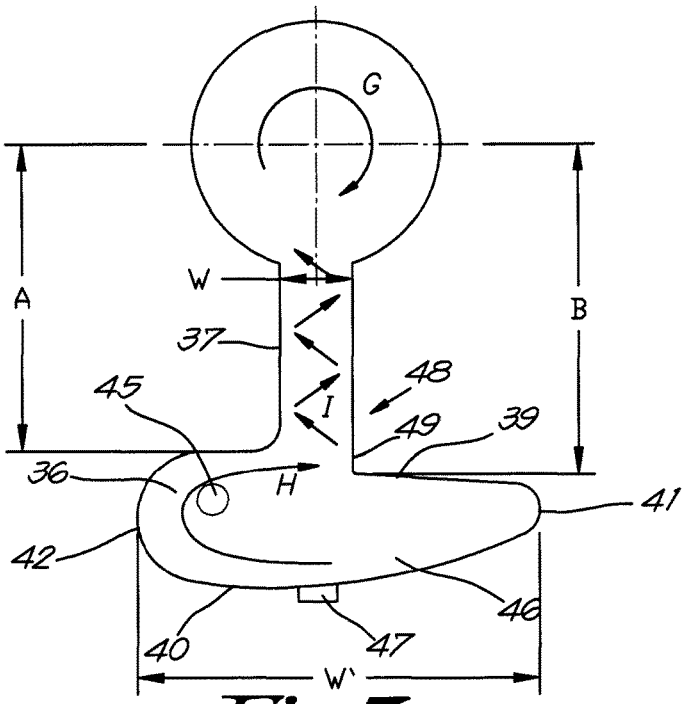
FIG. 3 schematically shows the outline of the shape of the oil chamber and oil channel indicated by F3 in FIG. 1 on a larger scale.

As shown in FIGS. 1 to 3 the oil chamber 36 has an asymmetric shape with respect to a radial plane through the connection of the oil channel 37 to the oil chamber 36, that coincides with the plane of the cross-section according to line II-II, whereby the section of the oil chamber 36 on one side of this plane is not as high as on the other side of this plane.

In the example the connecting wall 13 has a stepped form at the location of the connection 48, whereby the oil channel 37 connects to the oil chamber 36 at a distance A on one side of the connection 48 that is smaller than the distance B to the other side of the connection 48.

In this way at the location of the connection 48 a shoulder 49 is formed transverse to the connecting wall 39 in line with the oil channel 37 transverse to the connecting wall 39.

The operation of the scroll compressor 1 according to the invention is simple and as follows.

When the crankshaft 9 is driven, the rotor 8 will be given an orbiting motion such that, in a known way, due to the engagement between the fixed and movable scrolls 5 and 13, air or another gas or mixture of gases is drawn in via the inlet 28 as indicated by the arrow C, whereby this air, after compression, leaves the scroll compressor via the outlet 29 as indicated by the arrow D.

Upon compression heat is generated that ensures that the outer periphery of the rotor 8 that is in contact with the freshly drawn-in air is cooler than in the centre where the rotor 8 is in contact with hot compressed air.

Due to the driving of the crankshaft 9 the fan 30 is also driven such that ventilation air is drawn in via the inlet 33 as indicated by arrow E and blown, via the outlet 34, over the rotor 8 with its cooling fins 12 and oil chamber 36. If applicable the oil chamber 36 can also be provided with cooling fins.

Due to the orbiting motion of the rotor 8 in the direction of rotation of the arrow G, the oil 46 in the oil chamber is raised in the oil chamber 36 and swung around as shown by arrow H and thereby runs into the shoulder 49.

This shoulder thereby acts as a type of oil catcher at the connection 48 to the oil channel 37 that channels the captured oil further through the oil channel 37 by successive reflections between the sides of the oil channel 37 as shown by the arrows I.

Practice shows that in this way sufficient oil lubrication of the central bearing 17 can be realised and that the backflow of the oil 46 from the central bearing 17 to the oil chamber 36 can be realised via the same oil channel 37, without having to provide a separate drain channel.

The oil chamber 36 is in the coolest section of the rotor 8 close to the outer periphery of the rotor 8 and is additionally cooled by the cooling air originating from the fan 30.

The oil chamber 37 can be provided with cooling fins for better heat transfer to the cooling air.

When the scroll compressor is stopped, the oil 46 flows back from the central bearing via the oil channel 37 back to the oil chamber 36. Hereby a part of the oil remains behind in the oil cavity 50 that occurs in the outer ring 20 of the central bearing 17 at the bottom between the upright flanges 21 of the outer ring 20. Furthermore, when the central bearing is a bearing with the cylindrical roller elements that are held between an inner ring 19 and an outer ring 20, the outer ring is provided with flanges that demarcate an internal oil cavity 51.

This oil left behind ensures that when restarting the scroll compressor the central bearing is provided with sufficient oil for sufficient lubrication until the scroll compressor has come up to speed.

It is clear that such an oil cavity can be realised in other ways.

Figure 4:
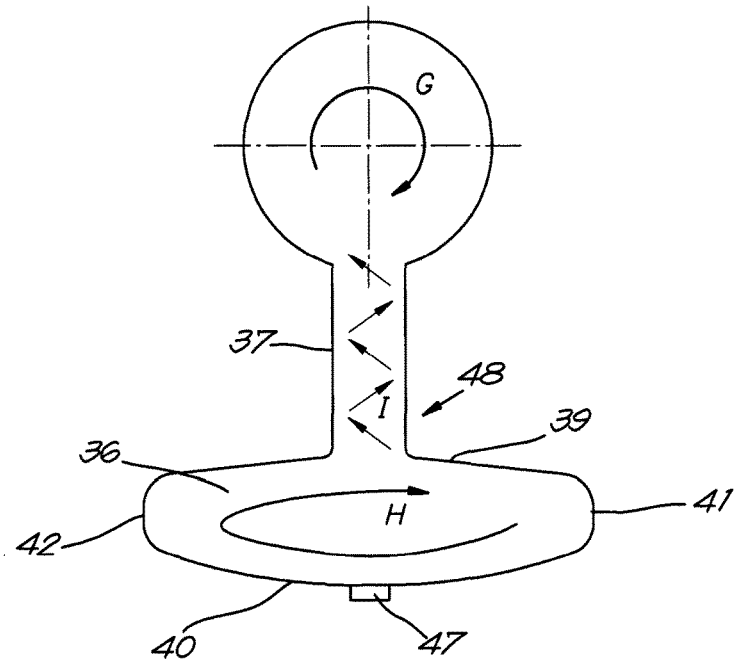
FIG. 4 shows a drawing such as that of FIG. 3, but for an alternative embodiment.

Depending on the intensity with which the oil is raised and swung around due to the motion of the rotor 8 a shoulder 49 is less of a requirement or is even superfluous, such as in the case of the variant embodiment of the oil chamber 36 as shown in FIG. 4, whereby in this case the sections of the oil chamber 36 on both sides of the connection 48 are just as high.

It is clear that the oil channel does not necessarily need to be straight and radial.

Although the scroll compressor 1 is shown with a horizontal crankshaft 9, it is not excluded using the scroll compressor 1 with a different orientation of the crankshaft 9.

However, preferably the crankshaft 9 or the main shaft 14 is not vertical but horizontal, or approximately horizontal.

The invention is by no means limited to the embodiment described as an example and shown in the drawings, but such a scroll compressor can be realised in different variants without departing from the scope of the invention.

The invention claimed is:

1. A scroll compressor comprising:

a housing with a fixed stator with a fixed scroll;

a movable rotor in this housing with a movable scroll cooperating with the fixed scroll;

a crankshaft that has a main shaft that is mounted on bearings in the housing and has a secondary shaft located eccentrically with respect to a geometric axis of the main shaft that is mounted on bearings in a centre of the movable rotor through the intervention of a central bearing;

a mechanism configured in a way to prevent a rotation of the movable rotor around its centre in such a way that a rotation of the crankshaft imposes an orbiting motion on the movable rotor, wherein the movable rotor is provided with an oil chamber that is able to be partly filled with oil such that upon a movement of the movable rotor, a part of the oil is thrown towards the central bearing in order to lubricate the central bearing, wherein the oil chamber is at a radial distance from the centre of the movable rotor and is connected to the central bearing by an oil channel that has a width that is less than a width of the oil chamber; and a fan for blowing cooling air along an outside of the oil chamber, wherein the oil chamber is defined by a connecting wall on top of the oil chamber and a wall opposite the connecting wall forming a base of the oil chamber, and wherein the oil channel connects to the connecting wall of the oil chamber forming a connection.

2. The scroll compressor according to claim 1, wherein a distance at which the oil chamber from the centre of the central bearing is greater than one third of a radius of an outer periphery of the movable rotor.

3. The scroll compressor according to claim 1, wherein the oil channel is of a straight form.

4. The scroll compressor according to claim 1, wherein the oil channel extends radially.

5. The scroll compressor according to claim 1, wherein, when the scroll compressor is at rest, a volume of the oil chamber is fifty to sixty percent filled with oil.

6. The scroll compressor according to claim 1, wherein at a location of the central bearing an oil cavity is provided wherein, after the stoppage of the scroll compressor, the oil cavity is configured in a way such that a quantity of oil remains behind at the location of the central bearing.

7. The scroll compressor according to claim 6, wherein the central bearing is a bearing with roller elements that are held between an inner ring and an outer ring, whereby the outer ring is provided with flanges that demarcate an internal oil cavity.

8. The scroll compressor according to claim 1, wherein the movable rotor is provided with a filling channel that is connected to the central bearing or to the oil channel.

9. The scroll compressor according to claim 1, wherein the oil chamber has a drain plug underneath.

10. A scroll compressor comprising:

a housing with a fixed stator with a fixed scroll;

a movable rotor in this housing with a movable scroll cooperating with the fixed scroll;

a crankshaft that has a main shaft that is mounted on bearings in the housing and has a secondary shaft located eccentrically with respect to a geometric axis of the main shaft that is mounted on bearings in a centre of the movable rotor through the intervention of a central bearing;

a mechanism configured in a way to prevent a rotation of the movable rotor around its centre in such a way that a rotation of the crankshaft imposes an orbiting motion on the movable rotor, wherein the movable rotor is provided with an oil chamber that is able to be partly filled with oil such that upon a movement of the movable rotor, a part of the oil is thrown towards the central bearing in order to lubricate the central bearing, wherein the oil chamber is at a radial distance from the centre of the movable rotor and is connected to the central bearing by an oil channel that has a width that is less than a width of the oil chamber; and a fan for blowing cooling air along an outside of the oil chamber, wherein the oil chamber is defined by a connecting wall on top of the oil chamber and a wall opposite the connecting wall forming a base of the oil chamber, wherein the oil channel connects to the connecting wall of the oil chamber forming a connection, and wherein at the location of the connection an oil catcher is provided on one side of the oil channel that is configured in a way such that the oil catcher catches at least a part of the oil which has been thrown up by the rotor and configured to channel the part of the oil in the direction of the oil channel.

11. The scroll compressor according to claim 10, wherein the oil catcher is formed by an asymmetric shape of the oil chamber with respect to a radial plane through the connection of the oil channel to the oil chamber, wherein a part of the oil chamber on one side of the radial plane is not as high as a part on the other side of the radial plane.

12. The scroll compressor according to claim 11, wherein the oil catcher is formed by a shoulder that is formed by the oil channel connecting to the oil chamber at a distance that is smaller on one side of the connection than the distance on the other side.

13. The scroll compressor according to claim 12, wherein the shoulder is formed by the connecting wall having a stepped form at the location of the connection of the oil channel to the oil chamber.

14. The scroll compressor according to claim 10, wherein the oil catcher extends in line with the oil channel.

15. The scroll compressor according to claim 10, wherein the oil channel extends radially and that the connecting wall is oriented transversely to the oil channel.

16. The scroll compressor according to claim 10, wherein the wall opposite the connecting wall is further away from the centre of the movable rotor than the connecting wall and that this opposite wall extends along a circular segment with its centre in the centre of the movable rotor.

17. The scroll compressor according to claim 10, wherein the oil chamber is defined by two sidewalls that connect the connecting wall and opposite wall together and which have a curved concave form.

18. The scroll compressor according to claim 17, wherein the sidewalls of the oil chamber connect seamlessly to one another, except at the location of the connection to the oil channel.

* * * * *

UNITED STATES PATENT AND TRADEMARK OFFICE

CERTIFICATE OF CORRECTION

PATENT NO. : 10,385,854 B2
APPLICATION NO. : 15/503279
DATED : August 20, 2019
INVENTOR(S) : Koen Stoop It is certified that error appears in the above-identified patent and that said Letters Patent is hereby corrected as shown below:

On the Title Page

Item (71), Line 2, delete "VENNMOOTSCHAP" and replace with --VENNOOTSCHAP--

Signed and Sealed this
Twenty-ninth Day of October, 2019

Andrei Iancu
*Director of the United States Patent and Trademark Office*